United States Patent [19]

Chrisoghilos

[11] Patent Number: 4,502,284

[45] Date of Patent: Mar. 5, 1985

[54] METHOD AND ENGINE FOR THE OBTAINMENT OF QUASI-ISOTHERMAL TRANSFORMATION IN GAS COMPRESSION AND EXPANSION

[75] Inventor: Andrei V. Chrisoghilos, Bucharest, Romania

[73] Assignee: Institutul Natzional de Motoare Termice, Bucharest, Romania

[21] Appl. No.: 387,888

[22] PCT Filed: Sep. 7, 1981

[86] PCT No.: PCT/RO81/00005

§ 371 Date: Jun. 3, 1982

§ 102(e) Date: Jun. 3, 1982

[87] PCT Pub. No.: WO82/01220

PCT Pub. Date: Apr. 15, 1982

[30] Foreign Application Priority Data

Oct. 8, 1980 [RO] Romania ..... 102311

[51] Int. Cl.[3] ..... F02G 1/04

[52] U.S. Cl. ..... 60/682; 60/519; 60/650

[58] Field of Search ..... 60/650, 682, 670, 517, 60/519

[56] References Cited

U.S. PATENT DOCUMENTS

| | | | |
|---|---|---|---|
| 3,169,375 | 2/1965 | Velthuis | 60/670 |
| 3,698,184 | 10/1972 | Barrett | 60/650 X |
| 3,867,815 | 2/1975 | Barrett | 60/682 |
| 4,009,573 | 3/1977 | Satz | 60/519 |
| 4,089,174 | 5/1978 | Posnansky | 60/682 X |

FOREIGN PATENT DOCUMENTS

| | | |
|---|---|---|
| 1134781 | 4/1957 | France . |
| 501821 | 2/1971 | Switzerland . |

*Primary Examiner*—Allen M. Ostrager

*Attorney, Agent, or Firm*—Karl F. Ross; Herbert Dubno

[57] ABSTRACT

The present invention refers to a procedure and a machine which make it possible to produce a quasi-isothermal compression or expansion process in any thermodynamic cycle consisting of such transformations. The procedure is possible owing to the fact that heat exchangers (A, B) independent of each other are used, in each of these heat exchangers (A, B) the working agent circulating intermittently in only one direction owing to the fact that the exchangers (A and B) are successively and cyclically connected to and disconnected from the volume of the working space (a).

2 Claims, 8 Drawing Figures

II-II

METHOD AND ENGINE FOR THE OBTAINMENT OF QUASI-ISOTHERMAL TRANSFORMATION IN GAS COMPRESSION AND EXPANSION

CROSS REFERENCE TO RELATED APPLICATION

This application is a national phase application of PCT/R081/00005 filed Sept. 7, 1981 and based upon a Romanian application No. 102 311 of Oct. 8, 1980 under the International Convention.

FIELD OF THE INVENTION

The present invention refers to a method as well as to an engine which make it possible to obtain a process of quasi-isothermal compression or expansion, i.e., a process in which the temperature of the working agent keeps nearly steady while undergoing practically insignificant variations all during the compression or expansion processes in any thermodynamic cycle subject to such transformations.

BACKGROUND OF THE INVENTION

Some methods have been developed with a view to obtaining a quasi-isothermal compression or expansion process, according to which, in order to obtain the theoretical condition of an isothermal transformation, i.e., the maintenance of equality between the mechanic work received during the compression phase or yielded during the expansion phase and the heat evacuated during the compression phase or the heat absorbed during the expansion phase respectively, the work space of variable size of an engine has been connected to a cooled heat exchanger, consisting of one or more heat exchange units, in series, during the compression phase and a heated heat exchanger during the expansion phase (U.S. Pat. No. 3,867,815). This method has the disadvantage that the volume of the heat exchangers adds to the volume of the dead space, detemined by the constructive parameters of the work space of variable size, thus preventing high compression ratios from being reached. In addition, owing to the fact that only one heat-exchanger is used, the equality between the received or transferred machanic work and the evacuated or absorbed heat respectively, cannot be ensured at any instant, consequently, the transformation curve moves significantly away from the theoretical isothermal curve, thereby damaging the efficiency of the cycle on the whole. Then there are also Stirling external combustion engines built according to different principles, in which, after the compression phase, the working agent is cooled inside a heat exchanger, afterwords run through a regenerator and finally introduced into a heated expansion space (Stirling engine, by G. Walker). This type of external combustion engines has the disadvantage of not being able to reach higher compression values, thereby affecting the general output of the engine.

SUMMARY OF THE INVENTION

According to the present invention, the above mentioned disadvantages are eliminated, in order to obtain certain transformations as close to the theoretical isothermal transformation as possible while preserving as high a compression or expansion ratio as possible, the volume of the heat exchangers does not add to the volume of the dead space determined by the constructive parameters of the working space of variable size because heat exchangers independent of each other, are provided in either of which the working agent runs intermittently in only one direction. These heat-exchangers are successively and cyclically connected to and disconnected from the working spaces of variable size, the duration of the connection between this working space and one of the independent exchangers is two phased, namely: in the isothermal compression, during the first phase there is a flow of the working agent from one cooled independent heat-exchanger into a working space of varriable size, until the pressures in the two spaces become equal; the working process is polytropic, the working agent in the working space conveying the heat to the working agent which comes from the exchanger, in the second phase the flow of the working agent is from the working space into the exchanger carrying the afferent heat, while the total compressed gas mass transmits the heat by means of the cooled independent exchanger; in the expansion isotherm, in the first phase, the flow of the working agent is from the working space of variable size into a heated independent heat exchanger until the pressures in the two spaces become equal, the working agent in the heat exchanger transmitting the heat to the working agent which comes from the working space in polytropic mixture and a second phase during which the working agent flows from the heated exchanger into the working space, carrying the afferent heat, while the total mass of the expandable working agent receives the heat by means of the heated independent heat exchanger; the connection to and disconnection from the working space of variable size of the independent heat exchangers is such that the lapse of time during which there is no connection between the working space and the exchanger ensures an isochoric evolution of the working agent in each exchanger while the heat is transferred towards the exterior during the compression, and heat is received from the exterior during the expansion isotherm, the thermodynamic transformation curve in the compression or expansion process appearing as a resultant of the summing up of some successive polytropic sequential transformations, whose continuity points are situated above and below the theoretical isothermal curve, such that the negative mechanical work in the compression quasi-isotherm and the positive mechanical work in the expansion quasi-isotherm are comparable with those of the theoretical isothermal transformations, the pressure of the working agent in the independent heat exchangers which ensures the circulation of the working agent in only one direction being ensured by the working space of variable size itself, owing to a self-stocking process, until, after a P series of cycles, a necessary steady value, self-repeatable with every cycle is reached.

According to the present invention, the rotary machine eliminates the disadvantages mentioned above, owing to the fact that, in order to materalize the procedure presented here above, it uses groups of independent heat exchangers, i.e. a group of cooled exchangers for the compression phase and a group of heated exchangers for the expansion phase, the successive connection and disconnection between these exchangers and the working space of variable size of the machine being obtained by means of a plurality of connection orifices, some galleries and pairs of windows provided both in the two distribution discs and in the two fixed lids of the engine housing, windows placed radially and secured tight, following a trapezoidal contour with expandable linear segments and plurality of pipes for the coupling of the exchangers themselves, a window which ensures the connection of the working space with the exchanger, in order to achieve the first phase of the quasi-isothermal tranformation process, while the second window ensures the connection for the second phase of the quasi-isothermal transformation process, the space between the two groups of windows corresponding to the groups of exchangers in the two lids secured tight with the aid of trapezoidal shaped segments placed continuously on blind trapezoidal contours, situated on the same diameter as the windows. The procedure and the machine for obtaining the quasi-isothermal transformation used in gas compression or expansion processes present, acording to this invention, the following advantages:

they ensure thermodynamic transformations as close to a theoretical isothermal transformation as possible;

they permit high compression or expansion ratios;

they ensure operation of the thermal machine at the highest possible efficiency for the same difference in temperature, as can be achieved with any cycle, the Carnot cycle included;

they permit any heat source to be used, such as geothermal or solar sources, as well as any type of gaseous, liquid or solid fuels;

they ensure a decrease in the fuel consumption, reducing the chemical and phonic pollution and;

they permit the thermic machine to be operated at low pressures and temperatures of the working agent, thus ensuring a decrease in the stress and wear level.

SPECIFIC DESCRIPTION

According to the present invention the method can be applied to any thermal machine that operates using a working space of variable size a which can be successively and cyclically connected to and disconnected from two groups of independent heat exchangers of $V_{a1}$, $V_{a2}$, $V_{a3}$ . . . etc. size, i.e. a group of cooled independent heat exchangers of identical construction A, and a group of independent heated heat-exchangers of identical construction B.

Every independent cooled heat exchanger A, used in the compression isotherm, is composed of some heat exchange units 1, provided with a window b for the flow of the working agent coming from exchanger A to the working space a, and a window c for the flow of the working agent coming from the working space a to the heat exchanger A. In the same way a heated exchanger B used in the expansion isotherm, is made up of a heat exchanger unit 2 provided with a window d for the flow of the working agent coming from the working space a to the exchanger B and a window e for the flow of the working agent coming from the exchanger B to the working space a.

Figure 1:
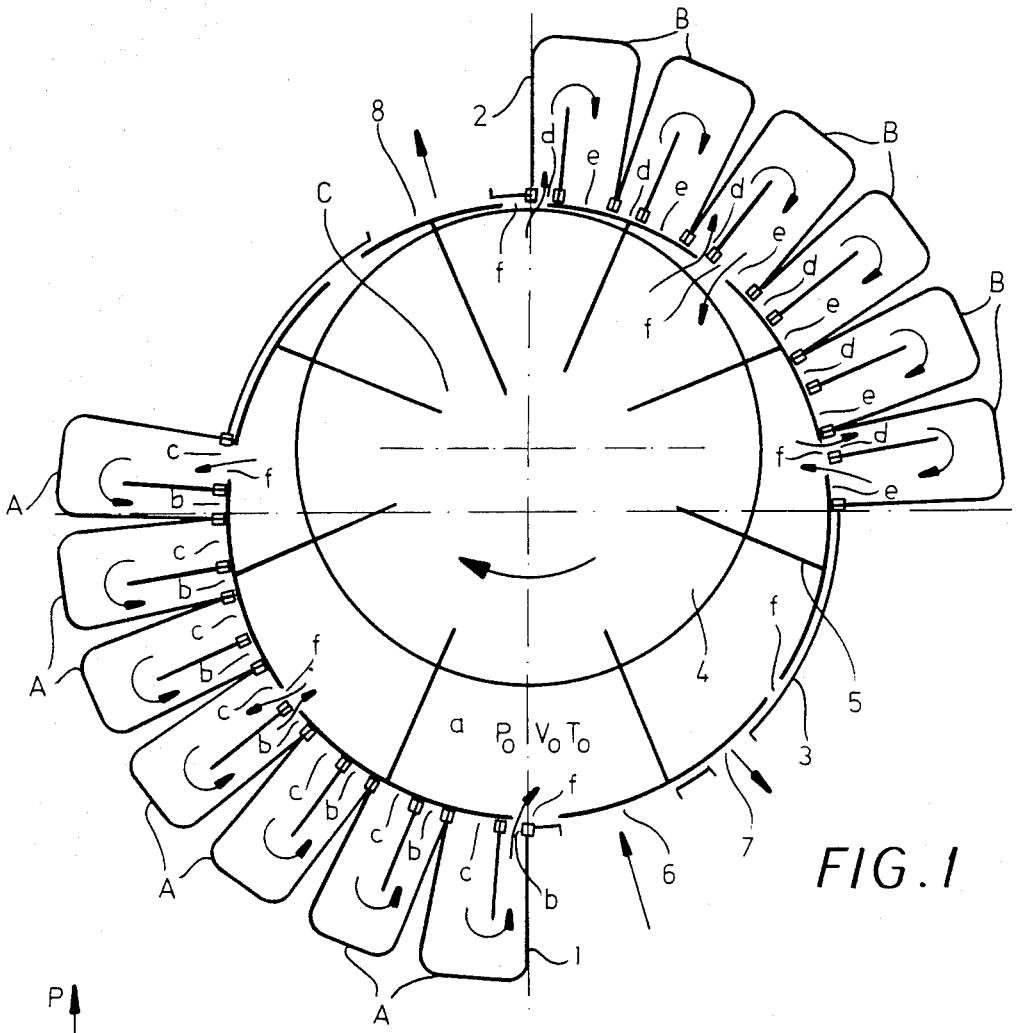
FIG. 1 is a diagrammatic section transverse to an axis of an engine showing compression or expansion processes.

The working space of variable size a can be developed according to the principle design shown in FIG. 1, on a rotary machine C, composed of a stator 3 and a rotor 4 in which glide the blades 5, example which is however non-limitative. The rotary machine C is provided with a suction (intake) connection 6 and a discharge connection 7, or a pressure connection 8. Following the motion of the rotor 4 the working space of variable size a, whose original parameters are $P_0V_0T_0$, will be successively connected in compression phase with the heat exchangers A and in expansion phase with the heat exchangers B by using the windows f provided in the wall of the working space. The state parameters of the working agent in the first heat exchanger A are $P'_1Va_1T''_1$.

The duration of the connection between the working space of variable size a and the heat exchanger requires two phases. In the first phase during which the working agent of the heat exchanger A flows towards the working space of variable size a, through the window b of the exchanger A and the window f in the wall of the working space, yielding together with the working agent of the working space a, a polytropic mixture whose state parameters are $P_{z1}$, $V_0+V_{a1}$, $T_{z1}$, the working agent of the working space transferring the heat to the working agent which comes from the exchanger.

Between the values of the original state of the two gases we have the following relations:

$$P_0<P'_1;\ T_0>T''_1,$$

while the polytropic mixture places its state parameters as follows:

$$P_0<P_{z1}<P'_1;\ T_0>T_{z1}>T''_1.$$

In the second phase the closing of the window b and the opening of the window c occur simultaneously, the two volumes being compressed together, while the gas flows now from the working space to the exchange through the windows f and c, carrying the afferent heat to the mass which leaves the working space.

At the same time, a part of the compression heat of the joint gases coming from the exchanger and the working space, is evacuated through the walls of the exchanger to the exterior, the compression showing a sub-adiabatic character. At the moment of detachment of the first cooled heat exchanger A from the working space, when the orifice c closes, the gas in the working space will be in ($P_1$, $V_1$, $T_1$) state and the gas in the first cooled heat exchanger A will be in the ($P_1$, $V_{a1}$, $T'_1$) state.

Compared to their original states, the state parameters of the two gases follow the relations:

the working space:

$$P_1>P_0;\ T_1\approx T_0$$

and the exchanger:

$$P_1 > P'_1;\ T'_1 > T''_1$$

As soon as the working space a detaches itself from the cooled heat exchanger A, it is connected to the next cooled heat exchanger A, where the process is repeated exactly as in the case of the first exchanger. The working agent in the heat exchanger A, disconnected from the working space, develops according to an isochore curve, exchanging heat in conditions of a steady volume all during the waiting period until it is connected to the next working space, which finds it in such state parameters that can be considered identical with the original parameters extant at the moment of contact with the first working space ($P'_1$, $V_{a1}$, $T''_1$).

After having run through all the heat exchangers in number of k, the working space a undergoes successively the states: ($P_0$, $V_0$, $T_0$); ($P_1$, $V_1$, $T_1$) . . . , ($P_k$, $V_k$, $T_k$) with the following relations between the state parameters:

$$P_0 < P_1 \ldots < P_k;$$

$$V_0 > V_1 \ldots > V_k;$$

$$T_0 \approx T_1 \ldots \approx T_k;$$

That is:

$P_k V_k$ constant, while the polytropic mixture presents the successive states:

$$(P_{z1}, V_0 + V_{a1}, T_{z1});\ (P_{z2}, V_1 + V_{a2}, T_{z2}) \ldots (P_{zk}, V_{k-1} + V_{zk}, T_{zk})$$

with the relations:

$$P_{z1} < P_{z2} \ldots < P_{zk};$$

$$T_{z1} \approx T_{z2} \ldots \approx T_{zk};$$

These are the very conditions of a quasi-isothermal evolution of the gas in the working space, i.e., an reduced alternative variation on either side of an isothermal curve.

At the same time every heat exchanger will undergo alternatively two states: ($P'_1$, $V_{a1}$, $T''_1$); ($P_1$, $V_{a1}$, $T'_1$); ($P'_2$, $V_{a2}$, $T''_2$); ($P_2$, $V_{a2}$, $T'_2$) . . . ($P'_k$, $V_{ak}$, $T''_k$); ($P_k$, $V_{ak}$, $T'_k$); while the state parameters follow the relations:

$$P'_1 < P_1;\ P'_2 < P_2; \ldots P'_k < P_k;$$

$$T''_1 < T'_1;\ T''_2 < T'_2; \ldots T''_k < T'_k;$$

$$P'_1 < P'_2 \ldots < P'_k;$$

$$T''_1 \approx T''_2 \ldots \approx T''_k$$

We emphasize the essential fact that the feeding with working agent of the exchangers, at working parameters, and the reproduction of these parameters with every cycle, are carried out automatically by the evolution of the cycle itself in which the working agent is absorbed by the suction stub 6, gradually stocking the working agent in every exchanger at stabilized parameters, reproducible with every cycle. The succession of the phenomena of absorbtion, polytropic mixture, common evolution of the united volumes and isochore cooling of the exchangers show a tendency to a steady equilibrium of the system, owing to a monotonous variation of the state parameters of the gas, in the working space as well as in the heat exchangers, towards steady limits, self reproducible with every cycle, limits whose values will be practically reached after some dozens of cycles, after the machine has been started.

The above explanations are based upon a mathematical research of the phenomena, out of which we present only the final results. Thus, the limits toward which tend the pressions $P_i$ in the working space when this latter detaches itself from each of the exchangers, are given by equations:

$$\frac{(V_0 + V_{a1})^{m2-m1}}{(V_1 + V_{a1})^{m2}} \cdot \left[\left(\beta_1^{\frac{1}{m1}} \cdot V_{a1}\right) \cdot P_1^{\frac{1}{m1}} + V_0 P_0^{\frac{1}{m1}}\right]^{m1} - P_1 = 0$$

$$\frac{(V_1 + V_{a2})^{m2-m1}}{(V_2 + V_{a2})^{m2}} \cdot \left[\left(\beta_2^{\frac{1}{m1}} \cdot V_{a2}\right) \cdot P_2^{\frac{1}{m1}} + V_1 P_1^{\frac{1}{m1}}\right]^{m1} - P_2 = 0$$

$$\frac{(V_1 + V_{a2})^{m2-m1}}{(V_2 + V_{a2})^{m2}} \cdot \left[\left(\beta_k^{\frac{1}{m1}} \cdot V_{ak}\right) \cdot P_2^{\frac{1}{m1}} + V_{k-1} P_{k-1}^{\frac{1}{m1}}\right]^{m1} - P_k = 0$$

in which, besides the notations already introduced here above, the following have also been used:

$m_1$, the polytropic exponent of the mixture of the two gases;

$m_2$, the polytropic exponent of the common evolution of the gas in the working space and in the exchangers;

$$\beta i = \frac{P_i}{P_i} = \frac{T''_i}{T'_i}$$

the isochore evolution factor of the gas in the exchanger number i during the waiting period between the successive contacts with the two working spaces.

If we consider that the gas in the working space of variable size mixes isothermally with the gas in the cooled heat exchanger, a hypotesis that is not far from the reality, that is $m_1 = 1$, the equations here under can be literally solved and we have the following relations for the stabilized values of the pressions $P_1$:

$$P_1 = \frac{P_0 V_0 (V_0 + V_{a1})^{m2-1}}{(V_1 + V_{a1})^{m2} - \beta_1 V_{a1} (V_0 + V_{a1})^{m2-1}}$$

$$P_2 = \frac{P_1 V_1 (V_1 + V_{a2})^{m2-1}}{(V_2 + V_{a2})^{m2} - \beta_2 V_{a2} (V_1 + V_{a2})^{m2-1}}$$

$$P_k = \frac{P_k V_{k-1} (V_{k-1} + V_{ak})^{m2-1}}{(V_k + V_{ak})^{m2} - \beta_k V_{ak} (V_{k-1} + V_{ak})^{m2-1}}$$

The values $P_i$ are finite if between the volumes in the working space ($V_i$) and the volume in the independent exchanger ($V_{ai}$) the relation:

$$(V_i+V_{ai})^{m2}-\beta_i V_{ai}(V_{i-1}+V_{ai})^{m2-1}>0$$

is maintained, thus obtaining the circulation of the working agent in the heat exchangers A and B in only one direction, i.e. in the direction explicitly shown here above, if between the same parameters we have the relation:

$$(V_i+V_{ai})^{m2}-\beta_i V_{ai}(V_i+V_{ai})^{m2}<0$$

for the quasi-isothermal compression and $$(V_i+V_{ai})^{m2}-\beta_i(V_{i-1}+V_{ai})^{m2}>0$$

for the quasi-isothermal expansion.

A similar development occurs in the expansion process, where the group of heat exchangers B make it possible that the phenomenon be described by the same equation as here above.

The intensification of the heat transfer up to the required level of the isothermal evolution of the gas in the working space with the aid of heat exchangers as shown in the present invention, is put into evidence by the relations already shown, on the one hand owing to the influence of the polytropic exponent of common evolution $m_1$ whose value lies in the vicinity of the unit, and on the other hand owing to theisochore heat exchange of the exchangers expressed by the factor $\beta_i$ which is inferior to the unit for the compression isotherm, and superior to the unit for the expansion isotherm.

The diagrams of the quasi-isothermal compression or expansion processes represented in FIGS. 2 and 3 respectively show that the curve of the real transformations q for the compression and h for the expansion occur as a resultant of the summing up of some successive polytropic sequential transformations whose continuity points i are placed above and below the theoretical isothermal curves j for the compression and l for the expansion. The diagram presented in FIG. 3 shows in temperature-entropy coordinates, only the curves of the real transformations, that is, curve n for the compression and curve o for the expansion.

Figure 2:
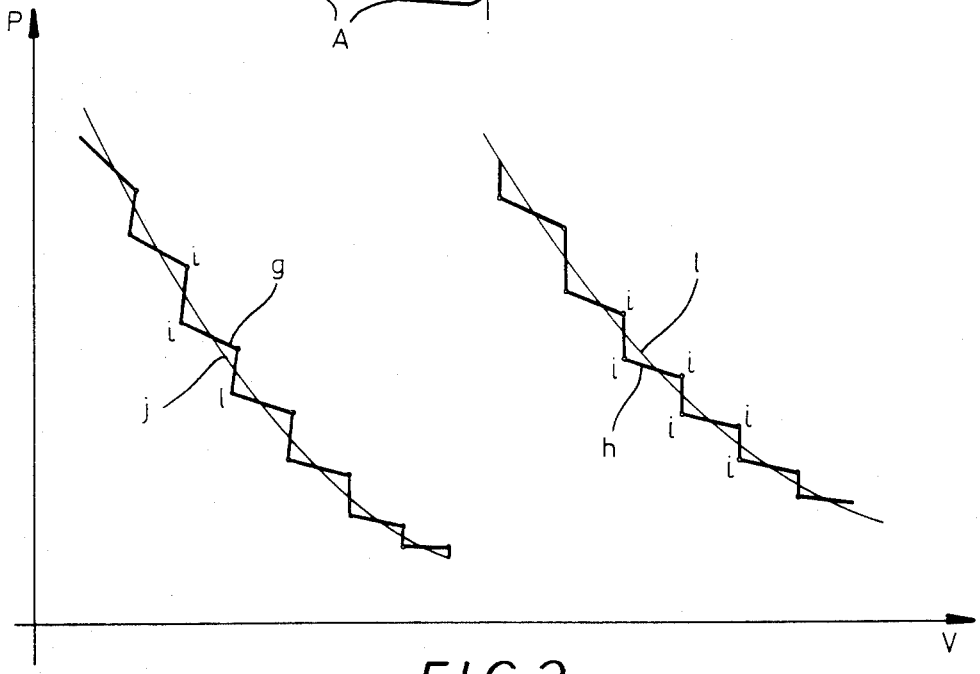
FIG. 2 is a pressure-volume diagram of the quasi-isothermal compression or expanssion processes.
Figure 3:
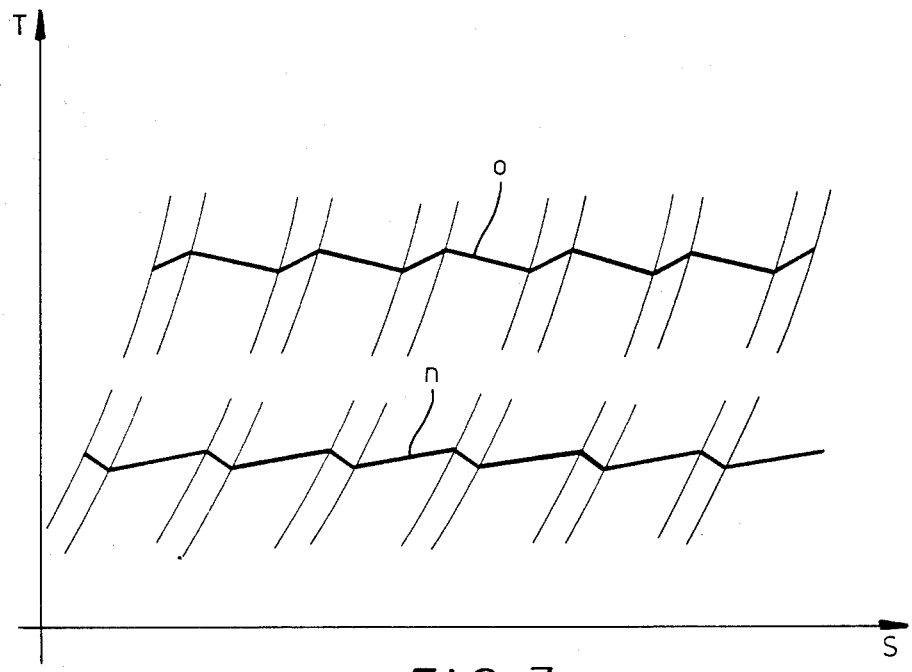
FIG. 3 is a temperature-entropy diagram of the quasi-isothermal compression or expansion processes.
Figure 4:
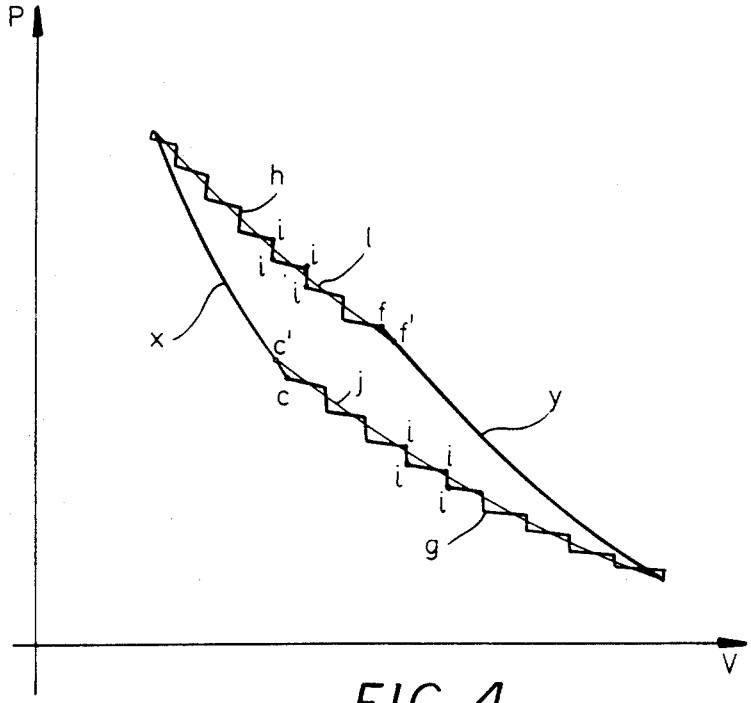
FIG. 4 is a theoretical pressure-volume diagram of the cycle of an external combustion rotary engine.
Figure 5:
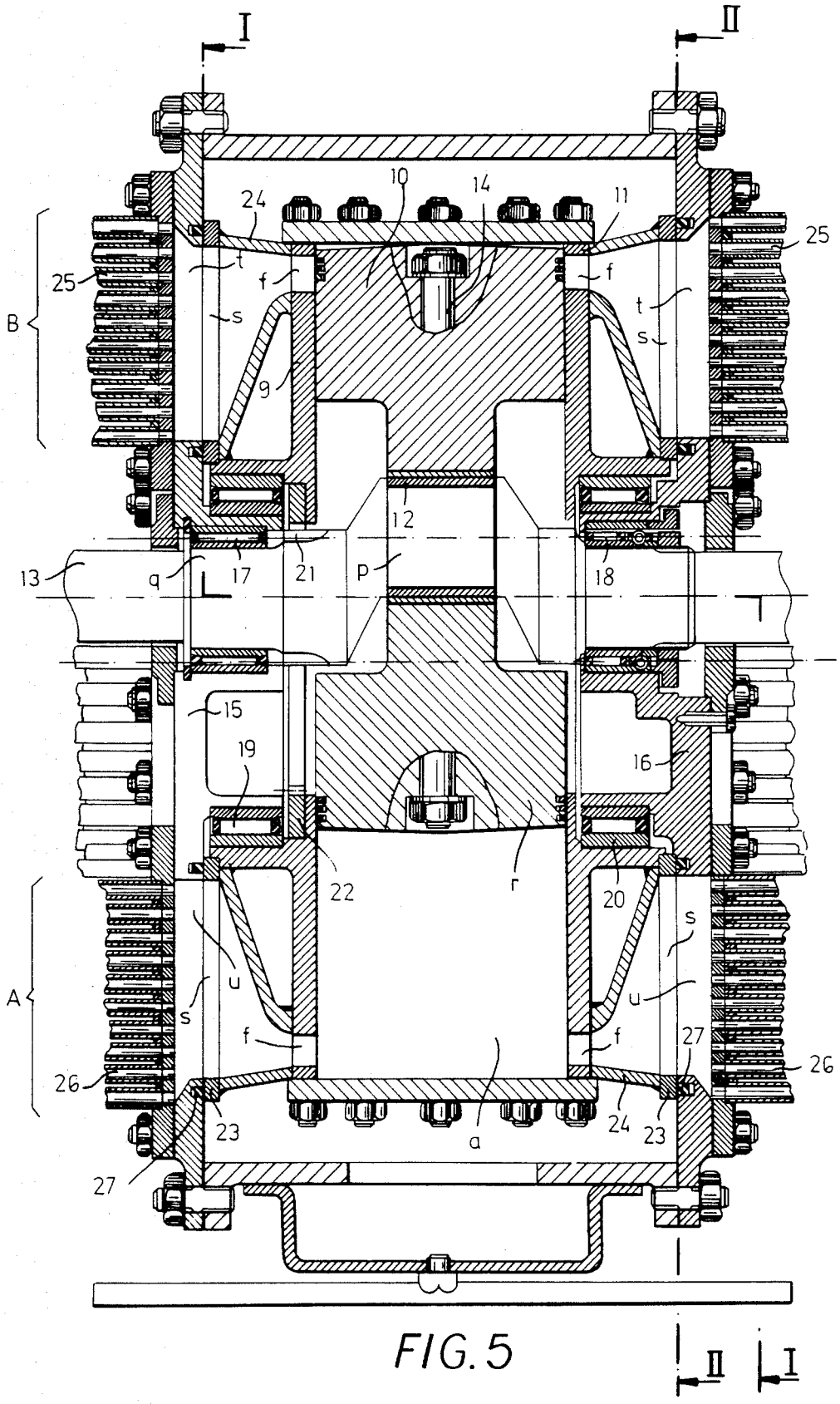
FIG. 5 is a longitudinal section of an external combustion engine according to invention.
Figure 6:
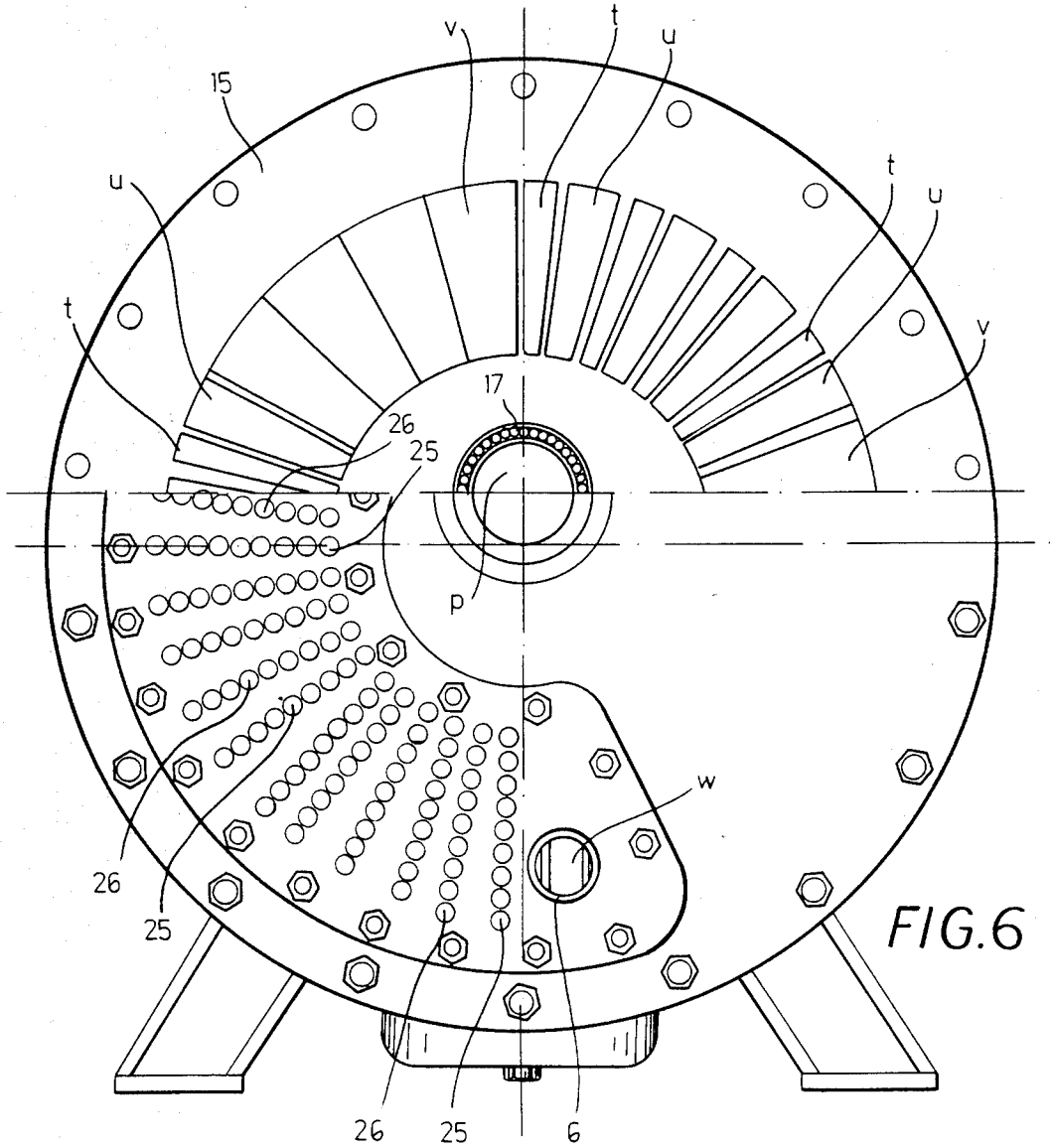
FIG. 6 is a cross-section of the engine along line I—I of FIG. 5.
Figure 7:
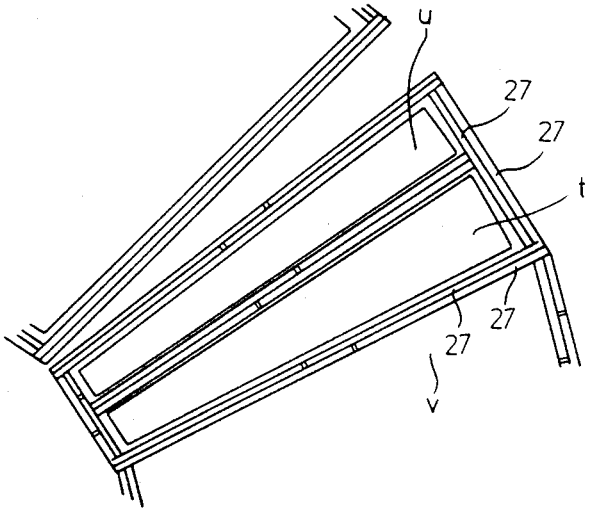
FIG. 7 is a detail of the sealing of the windows t and u.
Figure 8:
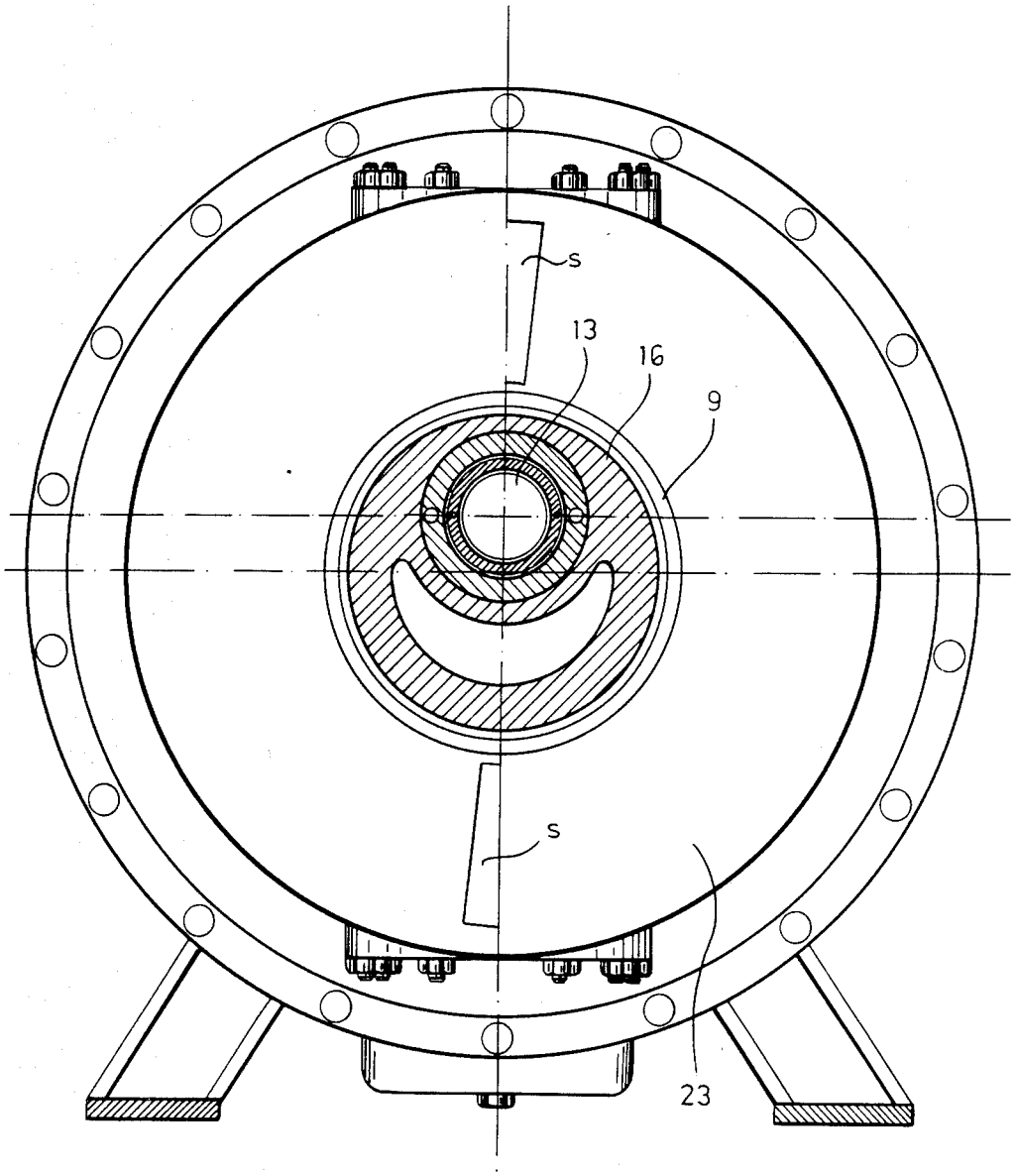
FIG. 8 is a cross-section of an engine taken along line II—II of FIG. 5.

The diagram in FIG. 2 shows that the negative mechanical work in the real compression quasi-isotherm q and the positive mechanical work in the real expansion quasi-isotherm h, are comparable to those of the theoretical isothermal transformations j and l.

The method referring to the quasi-isothermal transformation in gas compression or expansion processes can be applied to any working cycle of any thermic machine with a working space of variable size and with external heat sources, such as: compressors, external combustion engines, heat pumps, refrigerating machines, etc.

Below the method is described referring to a thermal machine which works as an external combustion engine.

According to the present invention the external combustion rotary engine is composed of a rotating cylinder 9, in which glides a double-acting piston 10, provided with the sealing rings 11. The double acting piston 10 is set at half way of its length, with the aid of the bearings 12 on a crankpin p of a crankshaft 13 and for the sake of the mounting it is composed of two coupled halves r, on the separation plane of the bearings by means of the bolts 14. The crankshaft 13 lies together with its main journals q in the lateral lids 15 and 16 with the aid of the rollerbearings 17 and 18 on the same axis. The rotary cylinder 9 lies on the lateral lids 15 and 16 with the aid of the roller bearings 19 and 20 which define an axis III—III perpendicular to the longitudinal axis of the cylinder, dividing it into two equal parts. On the crankshaft 13 there is a gear wheel 21 with external teeth which gears, in a 1:2 ratio, a gear wheel with internal teeth 22, fixed on the rotating cylinder 9. In the lateral walls of the rotating cylinder 9 there are four orifices f, communicating in twos with each of the working spaces of variable size a. Fixed on the body of the journal of the rotating cylinder 9 there are two distribution disks 23, one on either side of the rotating cylinder 9. The distribution disks 23 are each provided with two windows s whence galleries 24 start, these latter connecting windows s to windows f in the walls of the rotating cylinder 9. While rotating, the distribution disks 23 together with the rotating cylinder 9, make the windows s pass in front of the radial windows t and u disposed in the fixed lids 15 and 16 and placed on the same diameter as the windows s on the moving distribution disks 23, while t and u are tightened as against s.

The windows t are used for connecting the working space of variable size a to a heat exchanger A or B in the first phase, by means of some connections 25, while windows u are used for connecting the same working space to a heat exchanger A or B in the second phase of connection by means of connections 26. The connection 25 represents the outlet and connection 26 the inlet in a heat exchanger unit 1 or 2 already known and belonging with the groups of heat exchangers A or B.

Each of the windows t and u is tightened on a trapezoidal contour with the linear and expandable segments 27, disposed in the already known seats in the fixed lids 15 and 16. With the same linear and expandable segments, disposed in a continous row on blind trapezoidal contours, on the same diameter as windows t and u are also tightened the two spaces v, situated between the two groups of windows t and u corresponding to the groups of exchangers A and B.

On the external lids 15 and 16 are disposed, in the area corresponding to the external dead point of piston 10, windows w of the same shape and radial position as windows t and u each connected to a suction stub 6. In a similar way as windows t and u, windows w are sealed on a trapezoidal contour by means of the expandable linear segments 27. The suction windows w can be closed after the engine has reached the rated work regime by any kind of control; the control is correlated with the work parameters of the engine according to already known methods.

According to the present invention, an external combustion rotary engine works as follows. The working gases cause the double acting piston 10 to effect a motion of translation in cylinder 9, at the same time imposing on the crankshaft 13 and the rotating cylinder 9 a rotation around axis III—III at a speed of rotation equal to half the speed of rotation of the crankshaft. The motion of translation is purely harmonic, the maximum stroke of the piston being equal to four times the distance between the axis of the main journal p and the axis of the crankshaft 13; that is four times the excentricity of the crankpin. The total inertia forces result in a radial force, in phase with the position of the crankshaft; this radial force can be balanced on the crankshaft by means of fixed counterweights, according to a known procedure. None of the inertia and pressure forces acting upon the piston yields normal components between the piston and the walls of the cylinder.

The gearing of toothed wheels 21 and 22 does not participate in the transmission of the engine torque to the crankshaft. Theoretically, the mechanism is completely determined without this gearing. The gearing 21-22 doubles the kinematic chain piston-crankpin and its role is to facilitate the drive of the rotation of the cylinder when the direction of the acting forces would come under the friction cone, without participating in the transmission of the torque. The role of the gearing is consequently that of overcoming the friction in the rotating motion of the cylinder or of the inertia moment, caused by the variation in the number of rotations, taking over the only normal forces which could have appeared between the piston and the walls of the cylinder and would have determined the rotation of the cylinder. By introducing the gear, the contact between the piston and the walls of the rotating cylinder reduces only to the contact pressure of the rings necessary to sealing. The lubrication system of the components of the engine is generally known.

According to the present invention, the external combustion rotary engine works following a Carnot cycle composed of two quasi-isotherms q and h which represent the resultant of the addition of successive polytropic sequential transformations whose continuity points i are to be found above and below the theoretical isothermal curves j and l and adiabatic curves x and y easily obtainable by using a generally known external thermal insulation of the cylinder in the working space area.

The Carnot cycle can be obtained by means of an engine as shown in the invention, by the fact that in the first part of the compression, the working space of variable size a successively gets into contact with the cooled heat exchanger A along the connections 25 and 26, windows t and u in the lateral lids 15 and 16, window s on the distribution disk 23, galleries 24 and the windows f in the walls of the rotating cylinder 9, stocking part of the working agent in these exchangers and compressing in a quasi-isothermal manner the remaining working agent according to the method described here above.

As soon as the working space of variable size a has left the cooled heat exchanger A begins the adiabatic compression of the working agent that has been left in the working space up to the interior dead point of the piston. For this purpose the engine is provided with a generally known, corresponding thermal insulation.

The moment the piston reaches the interior dead point, the working space of variable size a is connected to the heated heat exchangers B, along the same course as shown here above, with which an exchange of working agent occurs in a similar way as already described, thus determining a quasi-isothermal expansion of the working agent left in the working space. After the working space has been disconnected from the last heat exchanger B, the working agent, left inside, undergoes an adiabatic expansion until the suction window w opens and the working space of variable size a comes to depression such that it will aspirate a quantity of working agent equal to the one stocked in the two groups of heat exchangers A and B during the previous cycle, then the cycle repeats itself successively and alternatively for the two working spaces a. The stocking process of the working agent in the working space arrives, after some dozens of rotations of the crackshaft, to a steady state when the necessary aspiration reduces to zero and the suction window w must be closed. After having closed window w the engine works with the working agent in closed circuit. The mechanical work of the cycle and the power of the engine increase in proportion with the increase in the aspiration pressure of the engine.

The aspiration of the working agent can be carried out directly either from the atmosphere or from a closed tank, in which case, the state parameters of the working agent can differ in value from the atmospheric parameters. The working agent may be any gas, gas mixture or a gas-liquid heterogenous mixture. The cooling of the heat exchangers A can be carried out in a usual way by using any cooling agent while the heating of the heat exchanger B can be obtained by using any heat sources including geothermal water, solar sources, nuclear energy or a fuel burner of any type.

The given example concerning a thermal machine built according to this invention is not limitative. If, according to the invention, a thermal machine were to work as a compressor, in comparison with the example already described, the group of heat exchangers B and the discharge connection 7 should be suppressed, preserving the heat exchangers A and the enlarged suction stub 6, while a pressure connection 8 would be used. A thermal machine as shown in the invention, which were to work as a compressor, could compress the gas in a single stage at relatively high compression ratios, rejecting the compressed gas at temperatures neighboring those of the environment. A compressor working according to the invention, owing to the rather low temperature in the compression space, can use synthetic materials for the piston, the segments, the valves, etc., needing a relatively simple construction and much reduced weight and dimensions, owing to the elimination of the intermediate compression stages.

If a thermal machine, as shown in the invention, were to work as heat pump or refrigerating machine, only the disposition of the two groups of heat exchangers should be modified in such way as to obtain a development of the cycle in opposite direction as compared to its work as an external combustion engine. A group of heat exchangers B would be the heat source and it would represent that part of the pump which supplies the heat, while the other group of heat exchangers A would represent that part of the refrigerating machine which could ensure the cooling.

The procedure and the machine for the obtainment of a quasi-isothermal transformation in gas compression or expansion processes can be applied in any industrial domain supposed to necessitate a compression or expansion isotherm such as chemical, refrigerating industries, etc., as well as in any technical domain for which thermodynamic transformations are needed in order to obtain mechanic energy, these latter being apt to be used in transport, electric power production domains, as well as in other fields.

I claim:

1. A method of operating a thermal machine which comprises in each cycle of displacement of a movable member relative to a stationary member defining a variable-volume chamber with said movable member:

(a) communicating said chamber with a cooled heat exchanger through one orifice thereof and then communicating said chamber with said cooled heat exchanger through a second orifice thereof;

(b) repeating step (a) with a succession of such cooled heat exchangers while progressively altering the volume of said chamber as said movable member is displaced relative to said stationary member;

(c) thereafter communicating said chamber with a heated heat exchanger through a first and a second orifice thereof in succession as said chamber is swept therepast with movement of said movable member relative to said stationary member;

(d) repeating step (c) with a number of heated heat exchangers in succession while progressively changing the volume of said chamber as said movable member is displaced past said heated heat exchangers; and (e) controlling the work of said movable member and the communication of said chamber with heat exchangers to maintain the expansion and compression at said chamber substantially quasi-isothermal.

2. A thermal machine comprising:

a stationary member provided with an array of cooled heat exchangers disposed along a closed path with each having a pair of orifices opening in succession along said path and a plurality of heated heat exchangers each having a pair of orifices opening in succession along said path; and a movable member displaceable relative to said stationary member and defining a chamber of variable volume, said movable member being provided with an opening communicating in succession with the orifices of said cooled heat exchangers and with the orifices of said heated heat exchangers to maintain a substantially quasi-isothermal condition during expansion and compression in said chamber.

* * * * *